US005489233A

United States Patent [19]

Cook et al.

[11] Patent Number: 5,489,233

[45] Date of Patent: Feb. 6, 1996

[54] POLISHING PADS AND METHODS FOR THEIR USE

[75] Inventors: Lee M. Cook, Steelville, Pa.; John V. H. Roberts, Newark, Del.; Charles W. Jenkins, Newark, Del.; Raj R. Pillai, Newark, Del.

[73] Assignee: Rodel, Inc., Newark, Del.

[21] Appl. No.: 224,768

[22] Filed: Apr. 8, 1994

[51] Int. Cl.[6] ..... B24B 1/00

[52] U.S. Cl. ..... 451/41; 451/527; 451/530; 451/537; 51/299; 51/298

[58] Field of Search ..... 451/527, 530, 451/537, 921, 526, 528, 529; 51/299, 298

[56] References Cited

U.S. PATENT DOCUMENTS

| | | | |
|---|---|---|---|
| 2,701,192 | 2/1955 | Maass | 51/298 |
| 4,055,029 | 10/1977 | Kalbow | 451/527 |
| 4,111,666 | 9/1978 | Kalbow | 451/527 |
| 4,271,272 | 6/1981 | Strickman et al. | 521/110 |
| 4,421,526 | 12/1983 | Strickman et al. | 51/296 |
| 4,476,186 | 10/1984 | Kato et al. | 428/290 |
| 4,569,861 | 2/1986 | Smith et al. | 427/244 |
| 4,581,287 | 4/1986 | Smith et al. | 451/532 |
| 4,709,513 | 12/1987 | Tingley | 451/41 |
| 4,927,432 | 5/1990 | Budinger et al. | 51/298 |
| 5,081,051 | 1/1992 | Mattingly et al. | 437/10 |
| 5,177,908 | 1/1993 | Tuttle | 51/283 R |
| 5,177,910 | 1/1993 | Norota et al. | 451/527 |
| 5,209,760 | 5/1993 | Wiand | 51/293 |
| 5,212,910 | 5/1993 | Breivogel et al. | 51/398 |
| 5,216,843 | 6/1993 | Breivogel et al. | 51/131.1 |
| 5,232,875 | 8/1993 | Tuttle et al. | 437/225 |
| 5,257,478 | 11/1993 | Hyde et al. | 51/131.1 |
| 5,287,663 | 2/1994 | Pierce et al. | 51/401 |

OTHER PUBLICATIONS

Product Information Sheets on Rodel Suba™, Politex™ and MH Pads, Rodel, Scottsdale, Arizona, 1992.

*Primary Examiner*—Bruce M. Kisliuk
*Assistant Examiner*—Derris Banks
*Attorney, Agent, or Firm*—Kenneth A. Benson

[57] ABSTRACT

An improved polishing pad is provided comprising a solid uniform polymer sheet having no intrinsic ability to absorb or transport slurry particles having during use a surface texture or pattern which has both large and small flow channels present simultaneously which permit the transport of slurry across the surface of the polishing pad, where said channels are not part of the material structure but are mechanically produced upon the pad surface. In a preferred version of the invention, the pad texture consists of a macrotexture produced prior to use and a microtexture which is produced by abrasion by a multiplicity of small abrasive points at a regular selected interval during the use of the pad.

28 Claims, 1 Drawing Sheet

POLISHING PADS AND METHODS FOR THEIR USE

BACKGROUND OF THE INVENTION

This invention relates to polishing pads used for creating a smooth, ultra-flat surface on such items as glass, semiconductors, dielectric/metal composites and integrated circuits. It particularly relates to the surface texture of such pads.

Polishing generally consists of the controlled wear of an initially rough surface to produce a smooth specular finished surface. This is commonly accomplished by rubbing a pad against the surface of the article to be polished (the workpiece) in a repetitive, regular motion while a solution containing a suspension of fine particles (the slurry) is present at the interface between the polishing pad and the workpiece. Commonly employed pads are made from felted or woven natural fibers such as wool, urethane-impregnated felted polyester or various types of filled polyurethane plastic.

The polishing rate for such a system is determined by the pressures and velocities employed as well as the concentration of fine particles in contact with the workpiece at any given time and the chemical reactivity of the slurry. To increase polishing rates, patterns of flow channels are commonly cut into the surface of polishing pads to improve slurry flow across the workpiece surface. Additionally, the reduction in the contact surface area effected by such patterning provides higher contact pressures during polishing, further enhancing the polishing rate. Typical examples of textured pads are grooved, embossed and perforated pads sold commercially by Rodel, Inc. of Newark, Del. under the trade names Suba and Politex. A typical grooved or embossed pattern is a 0.100 inch square grid of 0.008 to 0.014 inch depth recesses.

The texture described in the related art is generally of a fixed large dimension. Texture spacings or depths are of a dimension clearly visible to the unaided eye, i.e. they may be termed macrotexture. In most related art, macrotexture consists of a regular geometrical array of grooves or spaces to create simple polygonal, spiral, lined, cross-hatched or circular areas of raised relief. A typical example of this is U.S. Pat. No. 2,701,192 which discloses the use of concentric, radial and cross-hatched grooves of regular spacing to improve slurry uniformity. A more recent patent, U.S. Pat. No. 5,232,875, shows a regular array of perforations through the pad which enable slurry to flow up through the pad to the interface between the workpiece and pad. U.S. Pat. No. 5,177,908 shows patterns of grooves or perforations in the pad surface which vary in size or density from the center to the circumference of the polishing pad for the purpose of providing a constant, or nearly constant, surface contact rate to a workpiece.

Generally macrotexture is applied prior to the use of a pad, however, U.S. Pat. No. 5,081,051 describes a process for continuously forming a plurality of circumferential macrogrooves during the polishing process. As stated in the specification (col 3, lines 63–64) the pad employed is specifically one which itself is "capable of absorbing particulate matter such as silica or other abrasive materials", i.e., the pad possesses a preexisting porosity or surface texture.

The only related art which teaches the use of grooves and patterns of different sizes simultaneously U.S. Pat. No. 5,216,843 which discloses a method for continuously producing small scale grooves on the surface of a pad during the polishing process. As stated in the specification of this patent (col 4, lines 23–25) the pad employed is specifically one which is "capable of transporting abrasive particulate matter such as silica particles", i.e., a second type of microtexture is added to the already existing porosity or surface texture of the pad. These microgrooves are cut across a raised region between larger preformed grooves (macrogrooves) exclusively to facilitate slurry transport. Typical macrogrooves shown are a plurality of circumferential concentric grooves approximately 0.3 mm deep and 0.3 mm wide cut into the surface of a circular polishing pad. During pad rotation a conditioner arm having a diamond tip is swept across the pad surface in an oscillating radial fashion during polishing to produce a series of shallow radial microgrooves across the pad surface. These microgrooves, approximately 0.04 mm wide by 0.04 mm deep, facilitate slurry transport in the region between the macrogrooves.

While U.S. Pat. No. 5,216,843 recognized both macro- and microtexture as being contributors to slurry transport, no teaching was made as to any interrelation of the dimensions or concentration of each. Thus, while a range of macrogroove densities of between 2 and 32 macrogrooves per inch was specified, no range of microgroove densities is given. Moreover, the inventors specifically mentioned that the presence of the macrogrooves is optional and that radial microgrooves by themselves are sufficient for slurry transport. In addition, the inventors specifically taught that the process is restricted to those pads which are capable of permitting transport of slurry particles on the pad surface. Such pads, typified by the preferred embodiment, an IC60 pad manufactured by Rodel, Inc. of Newark, Del., possess a well defined surface texture capable of transporting slurry, and the pads are capable of considerable polishing activity by themselves when neither macrogrooves or microgrooves are present. Indeed, as an example, IC60 pads are widely employed in the glass polishing industry in such an unmodified state with good effect.

All prior art polishing pads known to the inventors are composite or multiphase materials which possess an intrinsic microtexture as a result of their method of manufacture. The surface microtexture is derived from bulk non-uniformities which are deliberately introduced during manufacture of the pad. When cross-sectioned, abraded, or otherwise exposed, said bulk texture becomes a surface microtexture. This microtexture, which is present prior to use, permits the absorption and transport of slurry particles, and gives rise to polishing activity without further addition of micro- or macrotexture to the pad. Examples of the various classes of prior art polishing pads are as follows:

1. Urethane impregnated polyester felts (examples of which are described in U.S. Pat. No. 4,927,432) possess a microtexture derived from the ends of projecting fibers within the bulk composite, together with associated voids.
2. Microporous urethane pads of the type sold as Politex by Rodel, Inc. of Newark, Del. have a surface texture derived from the ends of columnar void structures within the bulk of a urethane film which is grown on a urethane felt base.
3. Filled and/or blown composite urethanes such as IC-series, MH-series and LP-series polishing pads manufactured by Rodel, Inc. of Newark, Del. have a surface structure made up of semicircular depressions derived from the cross-section of exposed hollow spherical elements or incorporated gas bubbles.
4. Abrasive-filled polymeric pads such as those of U.S. Pat. No. 5,209,760 possess a characteristic surface texture consisting of projections and recesses where filler grains are present or absent.

In contrast, solid homogenous sheets of polymers such as polyurethane, polycarbonate, nylon, or polyester have been demonstrated to have no polishing activity, and are, in consequence, not employed as polishing pads.

As a consequence of the need for a composite structure, the process for manufacturing prior art polishing pads is quite complicated relative to the manufacture of solid homogenous plastics of equivalent dimensions and thicknesses. In addition, there is considerable variability in the structure of prior art polishing pads as a consequence of their manufacture. Thus, for example, variability in the density of the felt for pads of class (1) above, or variations in filler density for pads of class (3) above will cause a corresponding variation in surface texture and, therefore, in polishing performance. This variability is well known to those skilled in the art and is one of the biggest deficiencies of prior art polishing pads.

Moreover, all prior art polishing pads known to the inventors possess significant polishing activity without additional macrotexture or microtexture being present, i.e. both are added as a refinement or improvement to performance, and are not required for polishing activity.

Accordingly, it would be highly desirable to provide a surface texture which did not rely in any way on preexisting inhomogeneity in the bulk material. This would allow employment of previously unusable but highly desirable materials as polishing pads, with corresponding improvements in polishing activity, performance stability, performance variability, and cost.

SUMMARY OF THE INVENTION

An improved polishing pad is provided comprising a solid uniform polymer sheet having no intrinsic ability to absorb or transport slurry particles which during use has a surface texture or pattern comprised of both large and small flow channels present simultaneously, said channels permitting the transport of slurry across the surface of the polishing pad, wherein said channels are not part of the material structure but are mechanically produced-upon the pad surface. In a preferred version of the invention, the pad texture consists of a macrotexture produced prior to use and a microtexture which is produced by abrasion by a multiplicity of small abrasive points at a regular selected interval during the use of the pad.

BRIEF DESCRIPTION OF THE DRAWINGS

The summary of the invention, as well as the following detailed description of the preferred embodiments, will be best understood when read in conjunction with the appended drawings. For the purpose of illustrating the invention, there are shown in the drawings embodiments which are presently preferred, it being understood, however, that the invention is not limited to the specific embodiments disclosed. In the drawings.

DESCRIPTION OF THE PREFERRED EMBODIMENTS

The essential feature of polishing pads of the present invention is that they possess a surface texture having simultaneous large and small flow channels, said structure being produced solely by external means upon the surface of a solid homogenous material having essentially no preexisting bulk or surface texture. The surprising and unexpected feature of the present invention is that the simultaneous presence of large and small flow channels on the pad surface is by itself sufficient to produce a desirably high polishing activity. As will be shown in the examples below, materials which ordinarily do not possess polishing ability may be easily and readily activated to give desirably high levels of polishing activity, fully equivalent to commercially available prior art products.

Figure 1:
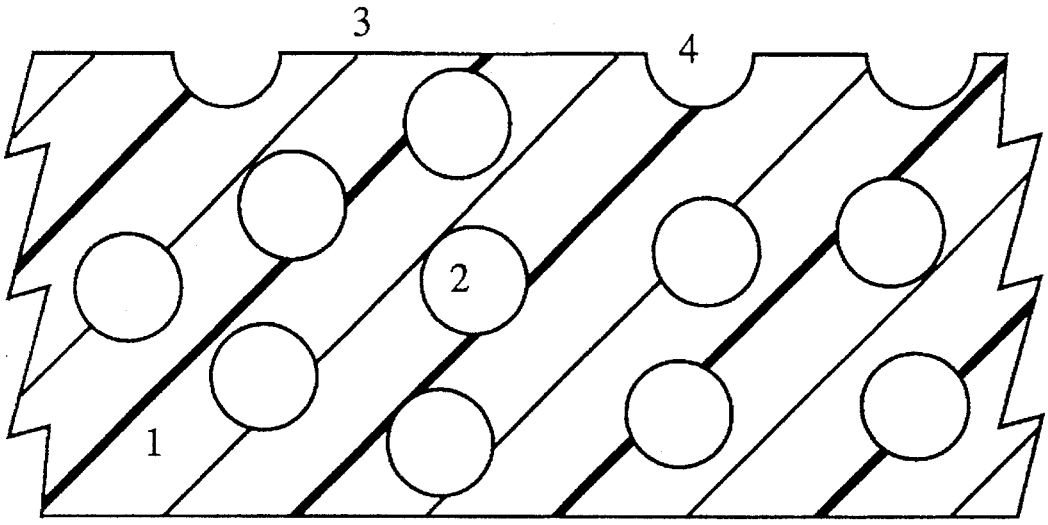
FIG. 1 is a representation of the cross-section of a prior art polishing pad of class (3) as outlined above.
Figure 2:
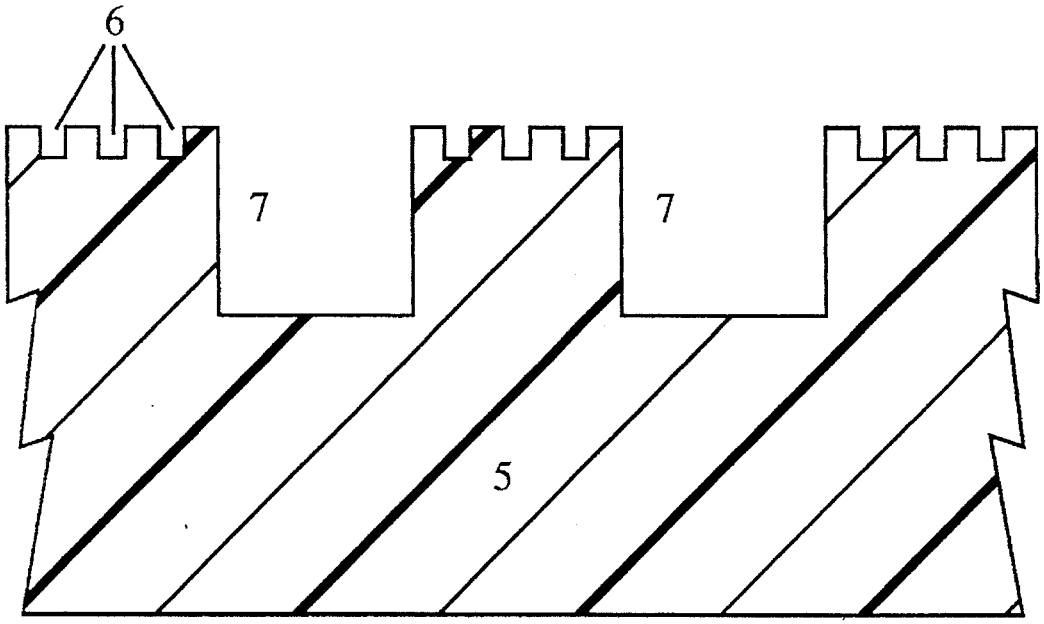
FIG. 2 illustrates a cross-sectional view of a polishing pad of the present invention.

An example of a prior art product is shown in FIG. 1 where the pad is a composite material consisting of a bulk plastic 1 which contains a large number of spherical voids or bubbles 2. At the outermost surface of the polishing pad 3, the exposed remnants or cross-sections of the internal voids 2 give rise to a series of surface recesses 4 which produce an intrinsic microstructure on the pad surface which is necessarily derived from the preexisting composite nature of the pad material. A pad of the present invention shown in FIG. 2 shows a solid homogenous polymer pad 5 having essentially no bulk microstructure which has on its surface a texture, produced by external means, which has small-scale flow channels, or microrecesses 6 and large-scale flow channels, or macrorecesses 7 present simultaneously.

An additional advantage provided by pads of the present invention is that, unlike prior art polishing pads, where the polishing rate is controlled by bulk microstructure and is largely fixed at the time of manufacture, rates can be readily and controllably adjusted simply by changing the pattern and density of the applied micro- and macrotexture. Application of texture is readily controlled and, moreover, is highly reproducible, resulting in a significantly reduced variability in performance. In contrast, when the same texture is applied to the surface of a prior art polishing pad, the preexisting variability in surface texture derived from the composite nature of said pad yields markedly increased variability.

Macrotexture in pads of the present invention consists of raised regions separated by recesses (macrorecesses) of selected dimensions which act as channels for the unimpeded flow of slurry. The most critical feature of macrotexture of the present invention is the distance between macrorecesses, which represents the distance between which slurry transport is controlled by the applied microtexture. In practice, an upper limit for macrorecesses spacing is 5 mm. Projecting features of substantially greater lateral dimension will exhibit significantly diminished polishing rate, regardless of the type of microtexture employed. A lower limit for macrorecess spacing is 0.5 mm. Below this limit the macrorecesses become difficult and time consuming to produce. Additionally, below the lower size limit, the structural integrity of the projecting surface between macrorecesses becomes degraded, and is subject to deflection or deformation, degrading polishing performance.

The pattern of the macrorecesses as well as their width and depth may be of virtually any pattern or size desired so long as the above limits are observed. In practice, the width and depth of the macrorecesses are generally held to below 50% of the largest lateral dimension of the projecting pad surface between macrorecesses, with macrorecess depth being at least equivalent to the width. Macrochannels may be of any desired depth, not exceeding 90% of the thickness of the pad. A deeper macrochannel gives longer pad life, given a finite erosion rate. If depth exceeds 90% of the pad thickness, the mechanical strength of the pad is seriously degraded and is thus avoided. Any of the patterns described in the prior art, for example, concentric circles, square grids, triangular grids, etc., may be used to advantage to provide projecting surface features such as concentric rings, rectangles, triangles, etc., with overall polishing rates increasing with increasing density of macrorecesses. Methods of producing macrorecesses on the pad surface may include, but are not restricted to, pressing, embossing, casting, cutting, or photolithographic means if the base polymer may be processed by this means. Depending on the pattern employed, the dimensions of the macrorecesses, and pad material properties, one may also produce macrorecesses during or immediately prior to the polishing process by means of cutting tools or other abrasive devices of appropriate dimensions and spacings. This technique is most effective for macrorecesses of the lower range of dimensions. It is also effectively employed as a means for regenerating macrorecesses in pads which have been worn to the extent that pre-existing macrorecesses have been worn away. In this case the simplest macrorecess patterns which can be applied are concentric circles or, preferably, randomly oriented lines. Macrorecesses are also not restricted to a single fixed set of spacings, widths, and depths. All may be combined in any pattern and combination desired with good effect within the dimensional restrictions outlined above.

Microtexture in pads of the present invention consists of a finer set of structures existing on the surface of the raised regions of the macrotexture which also act as channels for the unimpeded flow of slurry, albeit on a smaller scale. Accordingly, microtexture exhibits a smaller scale combination of projecting surface features and recesses (microrecesses) in which slurry flows. It is this unique combination of macroscopic and microscopic flow channels, present simultaneously, which allows complete, unimpeded, and uniform slurry flow to every portion of the pad surface.

By definition, the dimensions of the microrecesses are significantly below that of macrorecesses. Thus a practical upper bound for microrecess dimension is 0.25 mm, or at least half of the minimum dimension of the projecting features between macrorecesses, i.e., a bisection of this projecting area. A lower dimensional limit for microrecesses is at least 10 times the mean particle diameter in the slurry used for polishing. This lower limit is set by the requirement that the microrecesses permit unimpeded slurry flow. For channel sizes substantially below the lower limit, the probability of dilatant behavior, i.e. interparticle collisions giving rise to shear rate dependent increases in slurry viscosity, becomes undesirably high. Thus, for example, for a slurry where the mean particle diameter was 0.15 micron, a minimum microtexture dimension of 1.5 micron would be employed.

Methods for producing microtexture include, but are not limited to, embossing, pressing, casting, cutting, or photolithographic means if the base polymer may be processed by this means. In practice, due to the tendency of plastic materials to exhibit cold flow during use, the use of sharp abrasive devices to cut a series of randomly oriented grooves of dimensions and spacings delimited above at preset intervals during the use of said pads is preferred. Thus, while preexisting microtexture may be used for short-term uses, cold flow or erosion of the plastic material during use rapidly smoothes over the microtexture, resulting in significant and rapid decreases in polishing rate. To this end, preferred embodiments of the invention employ techniques to continuously regenerate microstructure in a controlled fashion either between uses or continuously during use depending upon the particular pad material employed and the duration of the polishing operation. Thus for relatively hard and durable materials such as nylon or polyurethane, which are relatively resistant to cold flow effects, intermittent regeneration of the microstructure immediately before each use of the pad has been found to be sufficient to ensure high and uniform polishing activity. For other pad materials, for example, polyethylene or polytetrafluoroethylene, which are more prone to plastic flow, continuous production of microtexture during the polishing process is more desirable. The best mode of generation of both macro- and microtexture for any particular base material can be readily determined by those skilled in the art for their particular purpose.

As is the case for macrorecesses, virtually any pattern of microrecesses may be employed so long as it uniformly covers the entire projecting surface of the pad and falls within the above mentioned size limits. A preferred microrecess pattern is a series of randomly oriented straight lines or grooves of randomly varying widths and depths. This randomizing effect gives rise to particularly desirable uniformity of the polishing rate across the entire surface area of the pad. This type of pattern is also particularly useful as it can be readily and inexpensively produced by abrading said pad surface with a rotating abrasive disk or pad which possesses a multiplicity of cutting teeth. Such disks are commonly employed as conditioning devices for prior art pads, thus effecting further economies. The inventors do not claim the conditioning disks per se as part of the present invention, but simply teach its employment as one means to achieve the desired microtexture on the pad surface.

While the above description outlines the essential features of the invention as applied to a single layer of homogenous plastic material, it is also possible to s add additional underlying layers of differing mechanical characteristics so as to modify pad deflection properties, along the lines outlined in U.S. Pat. Nos. 5,257,478, 5,212,910 and 5,287,663. Such a multilayered polishing pad is particularly well suited for the uniform polishing of semiconductor devices such as integrated circuit wafers, which possess a multiplicity of fine projecting features that must be removed in a highly uniform manner at all locations on the wafer surface. The employment of pads of the present invention as the outer contacting element of such a multilayered pad will provide a significantly enhanced range of achievable mechanical properties. In particular, the present invention enables practical use of extremely stiff thin plastic films as polishing materials, which have heretofore been unusable for this application. Such thin, high stiffness materials used as the outer contacting member in such a multilayered pad will give minimal small-scale deformation, promoting efficient removal of extremely small-scale surface projections while simultaneously giving a high degree of large scale compliance, effecting a significant improvement in removal rate uniformity across the global surface of the wafer. This represents a considerable extension and improvement of the existing technology.

The following examples serve to demonstrate the essential features of the present invention in contrast to prior art. They are not meant to be restrictive in any way. Upon examination of these examples and subsequent claims, additional implementations and uses will become apparent to those skilled in the art.

EXAMPLE 1

To illustrate the mode of operation of prior art polishing pads, a commercially available polishing pad (Rodel IC1000), of pad class (3) above, consisting of a polyurethane matrix filled with hollow spherical microballoons, was used to polish a series of 25 silicon wafers having a thermally oxidized surface layer ~1 micron in depth. The composition of the surface layer was silicon dioxide. Wafers were polished on a commercially available wafer polisher (Westech model 372) using a commercially available silica-based polishing slurry (Cabot SC-112) and a bonded diamond pad conditioner (RPC1) which was supplied as part of the polishing machine. The pad was conditioned for 30 seconds before each wafer was polished. As discussed above, the function of the conditioner is to generate a series of randomly oriented microscratches or grooves on the pad surface. Settings of the polishing machine, summarized below, were held constant for this and all other examples cited to ensure a direct comparison of performance. The polishing conditions used were: pressure, 9 psi; platen velocity, 20 rpm; carrier velocity, 46 rpm and polishing time, 2 min. A removal rate of ~1400 Angstroms per minute was observed for the test wafers.

EXAMPLE 2

A sheet of smooth solid, unfilled, essentially homogenous polyurethane (Rodel JR111) with no preexisting surface texture of any sort was then used to polish a series of 25 samples of thermally oxidized silicon wafers using the same polishing machine and conditions cited in Example 1, except that the diamond conditioning device was not employed. Thus in this test, no microtexture was extant on the pad surface. No measurable polishing activity was observed (i.e. removal rate was below 50 Angstroms/min). After turning on the diamond conditioning device so as to create microtexture on the pad surface, additional wafers were processed. An average polishing rate of 564 Angstroms/min was observed. The rate was quite variable. In addition, the removal rate across the wafer surfaces was observed to be highly non-uniform.

EXAMPLE 3

A series of annular grooves having a pitch of 0.055 in. and a depth of 0.012 in. were cut into two sheets of smooth, solid, unfilled, essentially homogenous polyurethane of dimensions and composition identical to the pad of Example 2. One sheet was used to polish a series of 25 samples of thermally oxidized silicon wafers using the same polishing machine and conditions cited in Example 1, except that the diamond conditioner was not used to produce microtexture prior to the polishing of each sample. Thus only macrotexture was present on the pad surface during use. A very low polishing rate of 570 Angstroms/min was observed, indicating a general lack of good polishing activity. Non-uniformity of polishing rate across the wafers was quite high.

The second sheet was then used to polish a series of 25 samples of thermally oxidized silicon wafers using the same polishing machine and conditions cited in Example 1, i.e. the diamond conditioner was used to produce microtexture prior to the polishing of each sample so that both micro- and macrotexture were extant on the pad surface during use. In sharp contrast to the first pad of the example, a high and uniform polishing rate of 1300 Angstrom/min was observed. Non-uniformity of polishing rate across the wafers was very low, fully equivalent to that of Example 1.

EXAMPLE 4

To further illustrate the importance of simultaneously maintaining macro- and microtexture in pads of the present invention, a series of annular grooves having a pitch of 0.055 in. and a depth of 0.010 in. were cut into a sheet of solid, unfilled, essentially homogenous polyurethane of differing composition from the previous examples (Dow Isoplast 302EZ). The macrotexture employed was of dimensions and patterning identical to the pads of Example 3. It was then used to polish a series of 100 samples of thermally oxidized silicon wafers using the same polishing machine and conditions cited in Example 1, i.e. the diamond conditioner was used to produce microtexture prior to the polishing of each sample. Thus the pad of this example had a surface texture during use which fully followed the teaching of the present invention. A high and uniform polishing rate of 1584 Angstroms/min was observed. Non-uniformity of polishing rate across the wafers was very low, equivalent to that of Example 1. At this point the conditioner was turned off (i.e., microtexture was not renewed) and 6 more wafers were processed. The polishing rate immediately dropped to less than 200 Angstroms/min. Examination of the pad after polishing showed an absence of microtexture when conditioning was not employed, i.e., cold flow or pad wear had completely removed microtexture, although macrotexture was unaffected.

EXAMPLE 5

A layered pad was constructed by bonding a 0.003 inch thick film of polyester to the surface of an untextured polyurethane sheet of composition and dimensions identical to that of Example 2. Again a series of 25 wafers were polishing using conditions identical to the previous Examples. Microtexture was produced before polishing each wafer using the diamond conditioner described above. Thus only microtexture was present on the pad surface during use. An average removal rate of 63 Angstroms per minute was observed.

EXAMPLE 6

A layered pad of composition identical to that of Example 5 was prepared. After bonding the polyester surface layer a series of annular grooves having a pitch of 0.055 in. and a depth of 0.010 in. were cut into the pad surface to create macrotexture. Again a series of 25 wafers were polishing using conditions identical to the previous examples. Microtexture was produced before polishing each wafer using the diamond conditioner described above. Thus the pad of this example had a surface texture during use which fully followed the teaching of the present invention. An average removal rate of 1359 Angstroms per minute was observed, in sharp contrast to the low rate of the previous example.

EXAMPLE 7

As a further indication of the wide variety of materials which can be employed using teachings of the present invention, a variety of plastic materials commonly found to have no polishing capability were tested. A macrotexture consisting of a series of annular grooves having a pitch of 0.055 in. and a depth of 0.010 in. were cut into each pad surface, in the same manner as for previous examples. The pads were used to polish 25 oxide wafers to determine rate. Again identical polishing conditions were employed. Microtexture was produced by conditioning the pad surface with the diamond conditioner prior to each wafer being polished using conditions outlined in Example 1 above. Thus all pads tested had a surface texture during use which fully followed the teaching of the present invention. Results are summarized below:

TABLE I

| Pad material | Average polishing rate (Angstroms/min) |
|---|---|
| Acrylic | 1330 |
| Polycarbonate | 1518 |
| Nylon 6 | 1195 |
| PET (polyethylene terephthalate), 0.003" over polurethane base | 1359 |

All materials showed desirably high polishing rates despite considerable variations in chemical composition and mechanical properties. None of these materials has been reported to have significant polishing activity by themselves.

We claim:

1. An improved polishing pad comprising a solid uniform polymer sheet with no intrinsic ability to absorb or transport slurry particles, said sheet in use having a surface texture or pattern comprising both large and smell flow channels which together permit the transport of polishing slurry containing particles across the surface of the polishing pad, said surface texture being produced solely by external means upon the surface of said solid uniform polymer sheet.

2. A pad according to claim 1 wherein the projecting surfaces between said large flow channels are of dimensions ranging from 0.5 mm to 5 mm in largest lateral dimension.

3. A pad according to claim 1 wherein the width and depth of said large flow channels are equal and do not exceed more than half of the largest lateral dimension of projecting surfaces between said large flow channels.

4. A pad according to claim 1 wherein said large flow channels have a depth greater than width, said depth not to exceed 90% of the overall thickness of said pad.

5. A pad according to claim 1 wherein said large flow channels are of several widths and depths present together.

6. A pad according to claim 1 wherein said solid uniform polymer sheet is a polyurethane.

7. A pad according to claim 1 wherein said solid uniform polymer sheet is a polycarbonate.

8. A pad according to claim 1 wherein said solid uniform polymer sheet is a nylon.

9. A pad according to claim 1 wherein said solid uniform polymer sheet is an acrylic polymer.

10. A pad according to claim 1 wherein said solid uniform polymer sheet is a polyester.

11. A pad according to claim 1, 2, 3, 4 or 5 wherein said large flow channels are arranged in a concentric annular fashion.

12. A pad according to claim 1, 2, 3, 4 or 5 wherein said large flow channels are arranged in a regular square grid pattern to produce projecting surface features of substantially rectangular outline.

13. A pad according to claim 1, 2, 3, 4 or 5 wherein said large flow channels are arranged in a regular grid pattern to produce projecting surface features of substantially triangular outline.

14. A pad according to claim 1, 2, 3, 4 or 5 wherein said large flow channels are straight and are randomly oriented with respect to each other.

15. A pad according to claim 1, 2, 3, 4 or 5 wherein the width of said small flow channels is constant and is of a dimension ranging from 0.25 mm to no less than 10 times the average size of the particles in the polishing slurry.

16. A pad according to claim 1, 2, 3, 4 or 5 wherein said small flow channels are of a multiplicity of widths and depths ranging from 0.25 mm to no less than 10 times the average size of the particles in the polishing slurry.

17. A pad according to claim 15 wherein said small flow channels are straight and are randomly oriented with respect to each other.

18. A pad according to claim 16 wherein said small flow channels are straight and are randomly oriented with respect to each other.

19. A layered polishing pad comprising two or more layers of polymeric materials wherein the surface layer is comprised of a solid uniform polymer sheet with no intrinsic ability to absorb or transport slurry particles, said sheet in use having a surface texture or pattern comprising both large and small flow channels which together permit the transport of polishing slurry containing particles across the surface of the polishing pad, said surface texture being produced solely by external means upon the surface of said solid uniform polymer sheet.

20. A layered polishing pad according to claim 19 wherein the non-surface layer or layers is substantially more compliant than said surface layer.

21. A layered polishing pad according to claim 19 wherein the non-surface layer or layers is substantially less compliant than said surface layer.

22. A method for polishing the surface of an article comprising: pressing said article against a polishing pad while polishing slurry containing particles is present on said pad and there is relative lateral motion between said article and said pad, in which said polishing pad is comprised of a solid uniform polymer sheet with no intrinsic ability to absorb or transport slurry particles, said sheet in use having a surface texture or pattern comprising both large and small flow channels which together permit the transport of said polishing slurry containing particles across the surface of said polishing pad, said surface texture being produced solely by external means upon the surface of said solid uniform polymer sheet.

23. A method according to claim 22 wherein said large flow channels are produced prior to use.

24. A method according to claim 22 wherein said large flow channels are produced at intervals during the polishing process.

25. A method according to claim 22 wherein said large flow channels are produced continuously during the polishing process.

26. A method according to claim 23, 24 or 25 wherein said small flow channels are produced prior to use.

27. A method according to claim 23, 24 or 25 wherein said small flow channels are produced at intervals during the polishing process.

28. A method according to claim 23, 24 or 25 wherein said small flow channels are produced continuously during the polishing process.

* * * * *

UNITED STATES PATENT AND TRADEMARK OFFICE

CERTIFICATE OF CORRECTION

PATENT NO. : 5,489,233
DATED : February 6, 1996
INVENTOR(S) : Cook et al.

It is certified that error appears in the above-identified patent and that said Letters Patent is hereby corrected as shown below:

Column 9,
Line 20, delete “smell” insert -- small --

Signed and Sealed this

Eleventh Day of June, 2002

*Attest:*

*Attesting Officer*

JAMES E. ROGAN
*Director of the United States Patent and Trademark Office*